United States Patent [19]

Hoenig et al.

[11] 3,998,086

[45] Dec. 21, 1976

[54] APPARATUS FOR PERFORATING THE NECKS OF AEROSOL CONTAINERS

[75] Inventors: James Robert Hoenig, Tinley Park; Salvador Carigan Mallorca, Chicago, both of Ill.

[73] Assignee: Continental Can Company, Inc., New York, N.Y.

[22] Filed: May 30, 1975

[21] Appl. No.: 582,438

Related U.S. Application Data

[62] Division of Ser. No. 524,146, Nov. 15, 1974, Pat. No. 3,910,213.

[52] U.S. Cl. ..... 72/325; 72/327; 72/338

[51] Int. Cl.[2] ..... B21D 28/04; B21D 28/02

[58] Field of Search ..... 72/338, 325, 327; 113/1 G, 1 TA, 120 H, 120 Z, 120 AA; 83/685, 686, 565; 225/93, 103, 104

[56] References Cited

UNITED STATES PATENTS

| | | | |
|---|---|---|---|
| 2,337,182 | 12/1943 | Calleson et al. | 113/120 H |
| 3,457,761 | 7/1969 | Brosseit | 72/325 |
| 3,706,292 | 12/1972 | Saunders | 113/120 H |
| 3,726,244 | 4/1973 | Arangelovich et al. | 113/120 AA |

FOREIGN PATENTS OR APPLICATIONS

| | | | |
|---|---|---|---|
| 19,994 | 2/1895 | United Kingdom | 83/688 |

*Primary Examiner*—Milton S. Mehr
*Assistant Examiner*—Dan C. Crane
*Attorney, Agent, or Firm*—Diller, Brown, Ramik & Wight

[57] ABSTRACT

This disclosure relates to a novel apparatus for perforating the necks of aerosol containers by providing an aerosol end for two or three piece containers having an annular shoulder joined by a radius to a cylindrical neck closed by an end wall, positioning the neck in exterior telescopic relationship to a punch having a circumferential axially terminal cutting edge, supporting the aerosol end in its telescoped position by seating of the end wall upon an end face of the punch, providing an annular guide ring with an internal diameter corresponding generally to the outer diameter of the neck, disposing the axes and imparting relative telescopic movement between the punch and guide ring to sever by a ripping action under tension the end wall from the cylindrical neck while at the same time sandwiching the latter between the inner and outer diameters of the ring guide and punch, respectively.

4 Claims, 3 Drawing Figures

APPARATUS FOR PERFORATING THE NECKS OF AEROSOL CONTAINERS

This application is a divisional application of commonly assigned application Ser. No. 524,146 filed Nov. 15, 1974 in the names of James R. Hoenig and Salvador C. Mallorca entitled A METHOD OF PERFORATING THE NECKS OF AEROSOL CONTAINERS, and now U.S. Pat. No. 3,910,213.

Aerosol containers are normally constructed from two or three pieces depending upon whether the container body is open ended and has double seam thereto a bottom end or whether the container body is drawn as a one-piece unit composed of an integral body wall and bottom end. In each case, however, a separate top end unit, generally a domed configuration, is double seamed to the remaining open end of the container body and in aerosol containers this end is generally domed and has a cylindrical neck which is subsequently curled for the application thereto of a conventional dispensing valve. Typical of such aerosol containers may be found in commonly assigned patents to Elmer J. Boik, U.S. Pat. No. 3,549,058, issued Dec. 22, 1970 entitled END UNIT AND LINER FOR AEROSOL CONTAINERS; Herbert S. Ruekberg, U.S. Pat. No. 3,700,136, issued Oct. 24, 1962, entitled END UNIT AND LINER FOR AEROSOL CONTAINERS; and James W. Kinnavy, U.S. Pat. No. 3,519,171, issued July 7, 1970 and entitled: DISPENSING CONTAINER WITH METERING AND DELAYED VALVE MECHANISM.

End units or closures of conventional aerosol containers are formed by blanking or stamping process and in conjunction with the usual domed end panel, initially include an upper annular shoulder joined at a juncture to a cylindrical wall of a neck which in turn is enclosed by an end wall. It is the end wall which must be perforated or removed to permit further fabrication of the neck, such as the curling thereof heretofore noted, prior to the application of a valve thereto. In the past, the removal of the end wall was through the use of an aligned perforating punch and guide ring having a cut edge with the latter elements forming conventional portions of conventional slide dies. The cut edge of the guide ring and the exterior surface of the perforating punch generally had a clearance therebetween of approximately 0.005 inch, however, due to the fact that conventional slide dies do not contain leader pins it is extremely difficult to obtain desired alignment of the punch to the guide ring cut edge. Basically one must rely for such alignment on the experience of a press operator or maintainer.

Alignment gauges are known for the purpose of avoiding the latter problem of misalignment at perforating stations for aerosol containers in slide dies. Though such gauges are reliable, their use is very time consuming because the punch assembly must be removed from the press, the gauge inserted, and the die pulled manually through the press by hand to assure alignment and permit adjustment which cannot, of course, be performed if the press were under power. After alignment, the gauge is removed, the punch assembly is again installed, and the press may be run. Needless to say down time due to such alignment is a very costly item when considering the tens of billions of aerosol end units which are manufactured in this fashion.

In keeping with the present invention, the cut edge of the guide ring is totally avoided and the system is self-aligning thereby resulting in less press down time between changes of guide rings and/or punches.

From an apparatus standpoint, there is provided a punch having a generally cylindrical exterior surface and a terminal end face upon which rests the end wall of an aerosol end unit, a juncture between the exterior end face and the terminal end of the punch defines an axially terminal circumferential cutting edge, and an annular guide ring devoid of a cut edge is moved relative to the punch such that upon relative telescopic movement between the punch and guide ring:

a. The aerosol neck is initially sandwiched between the inner and outer diameters of the guide ring and punch, respectively, b. An axial force is applied against the annular shoulder of the aerosol end unit whereby the neck unit is placed under tension, and c. Ripping of the end wall at its juncture with the neck occurs under the influence of tension forces at the cutting edge of the punch whereby at the completion of the telescopic movement the end is ripped from the neck and the latter is completely sandwiched between the guide ring and punch.

In further keeping with this invention the punch is preferably a tubular element and has associated therewith a knock out rod or pin which moves axially relative to a bore of the tubular punch to drive the ripped end wall of the aerosol end unit through the bore for the purpose of discharging the same.

IN THE DRAWING

Figure 1:
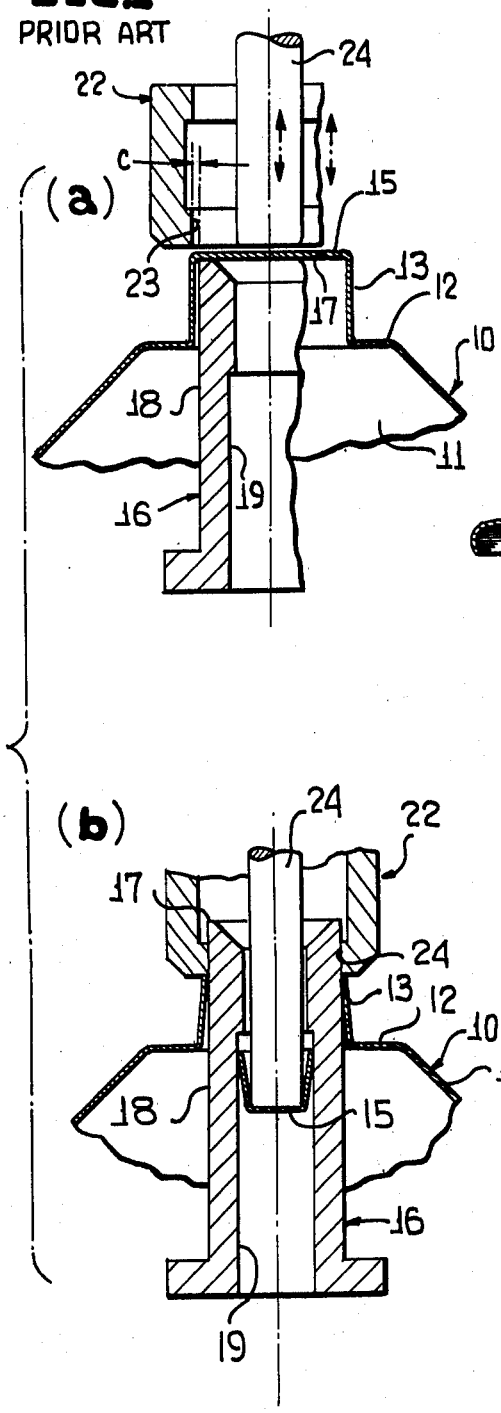
FIG.1 PRIOR ART
FIG. 1 is an exploded fragmentary sectional view of a conventional punch and die assembly for perforating aerosol end units, and illustrates a clearance between a cut edge of a guide ring and a punch (FIG. 1*a*) in the manner in which the cut edge cooperates with the punch to sever the end wall from the aerosol end unit neck.

For the purpose of better understanding the present invention reference is first made to FIG. 1 of the drawing which exemplifies typical punch and die assemblies for perforating or cutting the end walls from aerosol end units, the end unit illustrated being generally referred to by the reference 10 and having a dome 11, an annular shoulder 12, a neck 13, a radius 14, and a cylindrical end wall 15. The end unit 10 is positioned atop a punch 16 with the end wall 15 resting upon an upper terminal face 17 of the punch 16. The punch 16 is generally of a tubular configuration having an outer cylindrical surface 18 and an inner stepped surface 19. The punch 16 is, of course, assembled to a conventional press in a known manner.

A generally annular guide ring 22 is also conventionally mounted in the press in generally axial alignment with the punch 16. The conventional guide ring 22 has a step lower shoulder (unnumbered) defining a conventional cut edge 23 which has a clearance C of approximately 0.005 inch relative to the surface 18 of the punch 16. Thus, upon relative movement between the punch 16 and the guide ring 20, the cut edge 23 contacts the end unit 10 generally in the vicinity of the radius 14 and in cooperation with the outer surface 18 of the punch 16 continuing action results in the severance of the end wall 15 (FIG. 1*b*) and a downward descent of the end unit 10 relative to the upper face 17 of the punch 16, as is most apparent in FIG. 1*b*. A typical knock out rod or knock out pin 24 descends vertically during the operation of the press to drive the severed end wall 15 through the bore 19 of the punch 16 for subsequent discharge.

Upon the opposite motion of the knock out pin 14 and opposite relative telescopic motion of the punch 16 and the guide ring 22 suitable ejector means are provided for stripping the now perforated or opened neck end unit 10 from the punch 16.

As was mentioned earlier conventional slide dies do not include leader pins and this makes the alignment of the punch 16, particularly the surface 18 thereof, to the cut edge 23 of the guide ring 22 extremely difficult, again reliance being placed upon that of an experienced press maintainer. Through experience or through the use of an alignment gauge the prior art system as exemplified in FIG. 1 is operative but the down time due to alignment results in such cut edge and perforating punch combinations to become very costly from a production standpoint, particularly in view of the high quantity production carried on in the aerosol industry.

Figure 2:
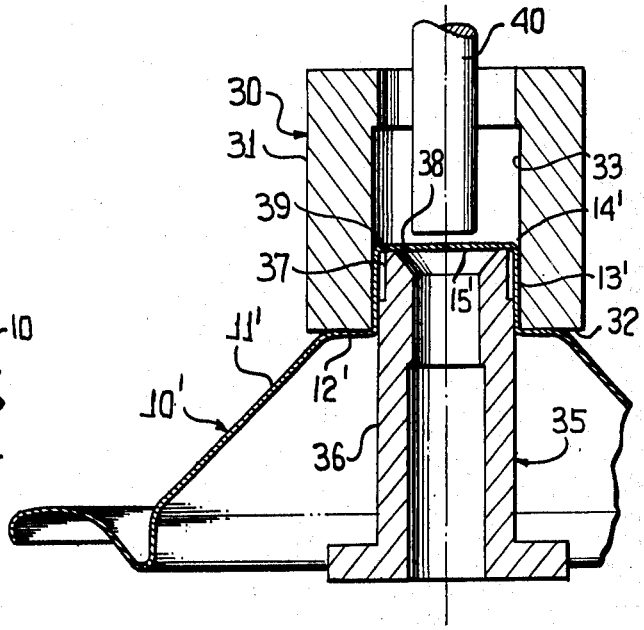
FIG. 2 is a fragmentary sectional view of an apparatus constructed in accordance with this invention, and illustrates a guide ring absent the conventional cut edge and the manner in which the neck of a container is initially sandwiched between an interior surface of the guide ring and an exterior surface of the punch.
Figure 3:
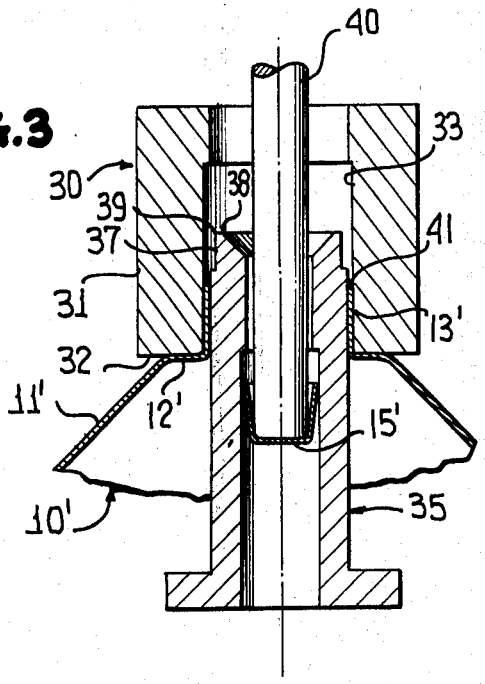
FIG. 3 is a view identical to FIG. 2, but illustrates the completion of the severing operation at which the neck of the end unit is sandwiched between the punch and guide ring while the ripped end wall thereof is discharged by a knock out pin.

In keeping with the foregoing, the present invention (FIGS. 2 and 3) is utilized to likewise perforate or open the end wall 15′ of a conventional aerosol end unit adapted for being double seamed in a conventional manner to a one-piece or two-piece can. Since the end unit of FIGS. 2 and 3 is identical to that of FIG. 1 added prime reference numerals have been applied thereto. However, in the case of the present invention a generally annular guide ring 30 includes an outer cylindrical surface 31, a lower annular terminal surface 32 and an inner cylindrical surface 33 devoid of the conventional cut edge 23 of conventional guide rings 22 (FIG. 1).

A punch 35 of the invention includes an outer cylindrical surface 36 with an upper end portion of the punch 35 being stepped to define a cylindrical upper surface 37 of a diameter less than that of the diameter of the surface 36. The surface 37 of the punch 35 merges with an annular end face 38 of the punch and at a juncture between the surfaces 37, 38 is an annular cutting edge 39 of the punch 35. A typical knock out pin 40 is utilized for removing the end wall 15′ after the same has been ripped from the neck 13′ at generally the juncture 14′, as will be described immediately hereinafter.

Assuming that the punch 35 and guide ring 30 are separated, an aerosol end unit 10′ is positioned upon the punch as shown in FIG. 2 with the clearance between the surfaces 36, 33 being such as to accommodate the thickness of the neck wall 13′. Upon relative telescopic motion between the punch 35 and the guide ring 30 by the conventional press heretofore mentioned, the annular end face 32 of the guide ring 30 is brought to bear against the annular shoulder 12′ of the aerosol end unit 10′. At this point no severing action has taken place (FIG. 2). Upon continued relative telescopic motion between the guide ring 30 and the punch 37 the material of the neck 13′ is placed under tension as the guide ring 30 applies downward forces against the annular shoulder 12′ while the punch 36 applies upwardly directed forces against the end wall 15′. When placed under sufficient force the material at generally the juncture 14′ fails under tension thus ripping the end wall 15′ from the neck 13′ generally along the radius 14′ as the latter is in contact with relatively sharp edge 39 of the punch 35. The stepped surface 37 of the punch 35 facilitates the ripping operation due to the fact that the sharp cutting edge 39 is not positioned exactly at the apex of the juncture 14′ and therefore a gradual bending of the radius 14′ occurs prior to its failure under tension.

At the conclusion of the perforating operation the neck 13′ is sandwiched totally between the surfaces 33, 36 of the guide ring 30 and the punch 35, in the manner best shown in FIG. 3. Due to this sandwiched condition any irregularities in the ripped edge 41 can be at least moderately smoothed or ironed out. The knock out pin 40, of course, operates in the manners heretofore described relative to the knock out pin 24 to remove the now severed end wall 15′ from the assembly through the bore (unnumbered) of the punch 35.

Upon reverse relative reciprocation of the guide ring 30 and the punch 35 the now perforated aerosol end unit 10′ may be removed for subsequent processing, such as the curling of the neck 13′ and the subsequent application thereto of a dispensing valve.

Due to the construction of the apparatus of FIGS. 2 and 3 the heretofore mentioned down time necessary for aligning conventional guide ring cut edge and punch is totally eliminated and, more important or just as important is the fact that the assembly is self-aligning particularly when used in presses having slide dies devoid of leader pins.

While preferred forms and arrangements of parts have been shown in illustrating the invention, it is to be clearly understood that various changes in detail and arrangement of parts may be made without departing from the spirit and scope of this disclosure.

We claim:

1. Apparatus for perforating the necks of aerosol containers comprising a punch having a generally cylindrical exterior surface, an axial bore and a terminal end face, a juncture between said exterior surface and terminal end face defining an axially terminal circumferential cutting edge, an annular guide ring having an interior generally cylindrical surface, means for providing relative axial movement between said punch and guide ring, said punch including a terminal cylindrical surface adjacent said end face of a reduced diameter as compared to the remaining diameter of said punch cylindrical exterior surface thereby providing a relief area to facilitate the drawing of an aerosol end neck wall in sandwiched relationship between said punch cylindrical exterior surface and said annular guide cylindrical interior surface during relative movement therebetween whereby an end wall of the aerosol end is ripped under tension by said cutting edge, a knockout pin in alignment with said bore, and means for moving said knockout pin into said bore from a position spaced from said terminal end face whereby said end wall is discharged through said bore.

2. The apparatus as defined in claim 1 wherein said guide ring is devoid of a conventional cut edge.

3. The apparatus as defined in claim 1 wherein said guide ring and punch are part of a conventional slide die devoid of leader pins.

4. The apparatus as defined in claim 2 wherein said guide ring and punch are part of a conventional slide die devoid of leader pins.

* * * * *